US005988753A

United States Patent [19]

Lin

[11] Patent Number: 5,988,753

[45] Date of Patent: Nov. 23, 1999

[54] COMBINATION OF A ROCKING CHAIR AND AN ADJUSTABLE HASSOCK

[76] Inventor: Jing-Long Lin, 11F-2, No. 43, Chia-I Street, Taichung City, Taiwan

[21] Appl. No.: 09/226,274

[22] Filed: Jan. 7, 1999

[51] Int. Cl.[6] ..... A47C 7/50

[52] U.S. Cl. ..... 297/423.26; 297/423.25; 297/423.28; 297/281

[58] Field of Search ..... 297/423.25, 423.26, 297/423.28, 267.1, 281

[56] References Cited

U.S. PATENT DOCUMENTS

| | | | |
|---|---|---|---|
| 659,933 | 10/1900 | Marks | 297/423.26 |
| 665,005 | 1/1901 | Harmon | 297/267.1 |
| 1,164,421 | 12/1915 | Smith | 297/423.26 X |
| 1,236,517 | 8/1917 | Wemple | 297/423.26 X |
| 1,404,449 | 1/1922 | Lahm | 297/423.26 X |
| 1,587,253 | 6/1926 | Tarbox | 297/423.26 X |
| 2,625,983 | 1/1953 | Slyter et al. | 297/267.1 X |
| 2,630,164 | 3/1953 | Finwall | 297/423.26 X |
| 4,358,156 | 11/1982 | Shartt | 297/423.28 |

*Primary Examiner*—Peter R. Brown
*Attorney, Agent, or Firm*—Charles E. Baxley, Esq.

[57] ABSTRACT

A rocking chair has two side panels each of which has an engaging hole and a plurality of positioning holes, a first bar and a second bar connected between the two side panels. A footrest has two side plates pivotally connected to the two side panels by a rod extending through the engaging holes and the side plates, each of the two side plates having a match holes so that the footrest is positioned relative to the two side panels by extending two pins through the positioning holes and the match holes. The two side plates can be rested on the first bar. Each of the two side plates has a notch defined therein so that the footrest can be folded between the two side panels by engaging the second bar with the two notches.

5 Claims, 4 Drawing Sheets

COMBINATION OF A ROCKING CHAIR AND AN ADJUSTABLE HASSOCK

FIELD OF THE INVENTION

The present invention relates to a rocking chair and an adjustable footrest which can be pivoted relative to the rocking chair.

BACKGROUND OF THE INVENTION

A conventional rocking chair is shown in FIG. 1 and includes a seat back 700, a seat 70 with two armrests 701 and a rocking mechanism 73 disposed below the seat 70. The rocking mechanism 73 includes two side panels 71, 72 which are each connected pivotally to a link system of the mechanism 73 so that user may sit in the rocking chair with his/her feet on a floor and rock his/her body so that the seat 70 together with the seat back 700 reciprocatingly move. This rocking chair has a fixed size so that the users may feel uncomfortable if the chair is too small or too big for the users. Besides, the user's feet have to step on the floor and apply a downward force so that he/she can push his/her hip portion backward to rock the chair. This limits the user's pose and the user's height.

The present invention provides a combination of the rocking chair and-footrest wherein the footrest can be adjusted relative to the rocking chair so that the limitations for using the chair are reduced. Therefore, the present invention obviates the inherent shortcoming of the conventional rocking chair.

SUMMARY OF THE INVENTION

In accordance with one aspect of the present invention, there is provided a combination of a rocking chair and a hassock. The rocking chair comprises a seat, a seat back extending from a rear edge of the seat, a stand supporting the seat and a rocking mechanism connected to the stand. Side panels respectively extend from two sides of the seat and each of which has an engaging hole defined therethrough. A first bar is connected between the two panels.

The footrest has two side plates and each of which has an aperture so that the two side plates are pivotally connected each one of the two side panels by extending a rod through the two engaging holes and the two apertures. The two side plates are rested on the first bar by their undersides.

The object of the present invention is to provide a rocking chair and a footrest wherein the footrest can be adjusted by changing its angle relative to the chair.

Another object of the present invention is to provide a rocking chair and a footrest wherein the footrest can be folded between the two side panels of the chair.

Further objects, advantages, and features of the present invention will become apparent from the following detailed description with appropriate reference to the accompanying drawings.

DETAILED DESCRIPTION OF THE PREFERRED EMBODIMENTS

Figure 1:
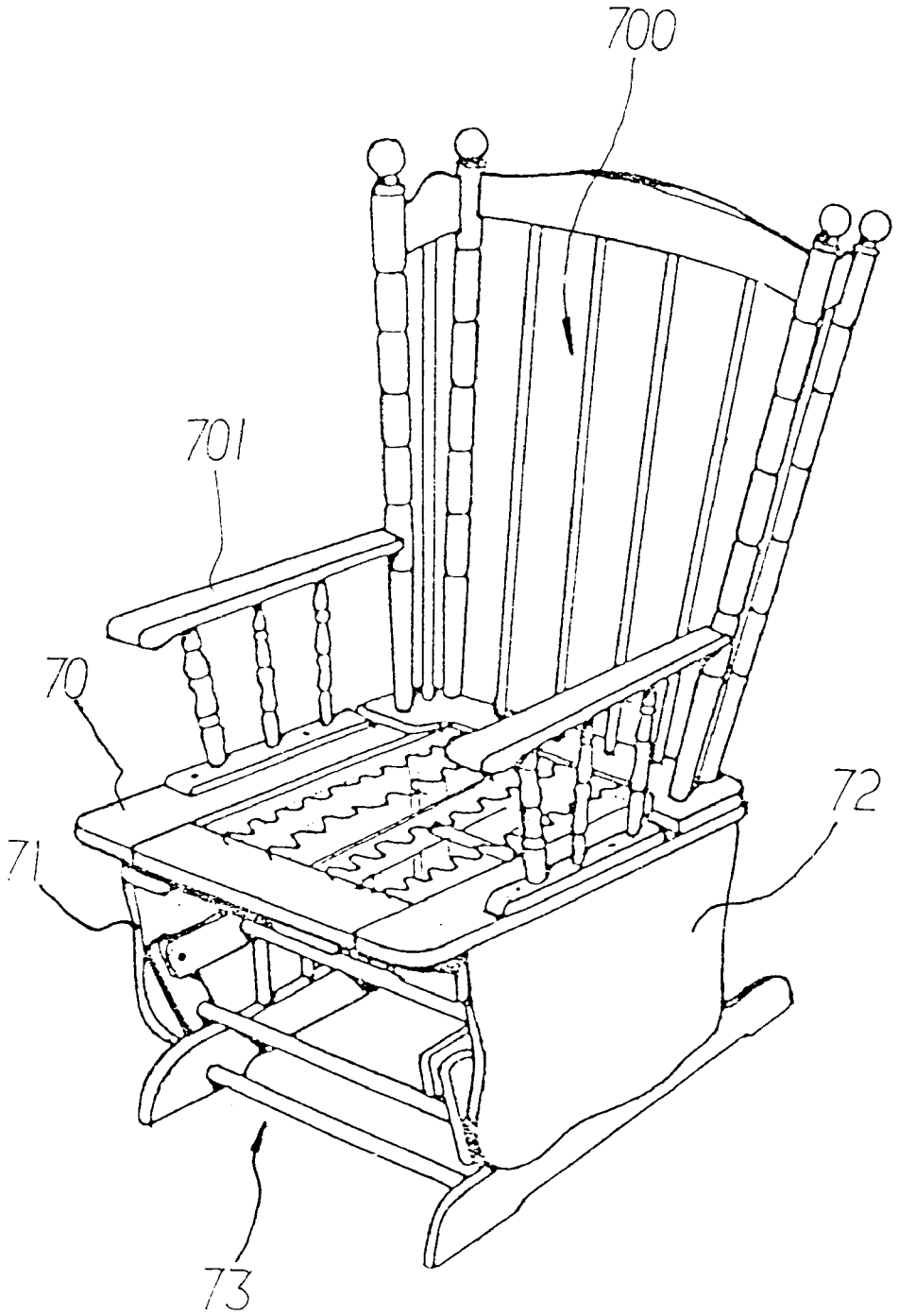
FIG. 1 PRIOR ART
FIG. 1 is a perspective view of a conventional rocking chair.
Figure 2:
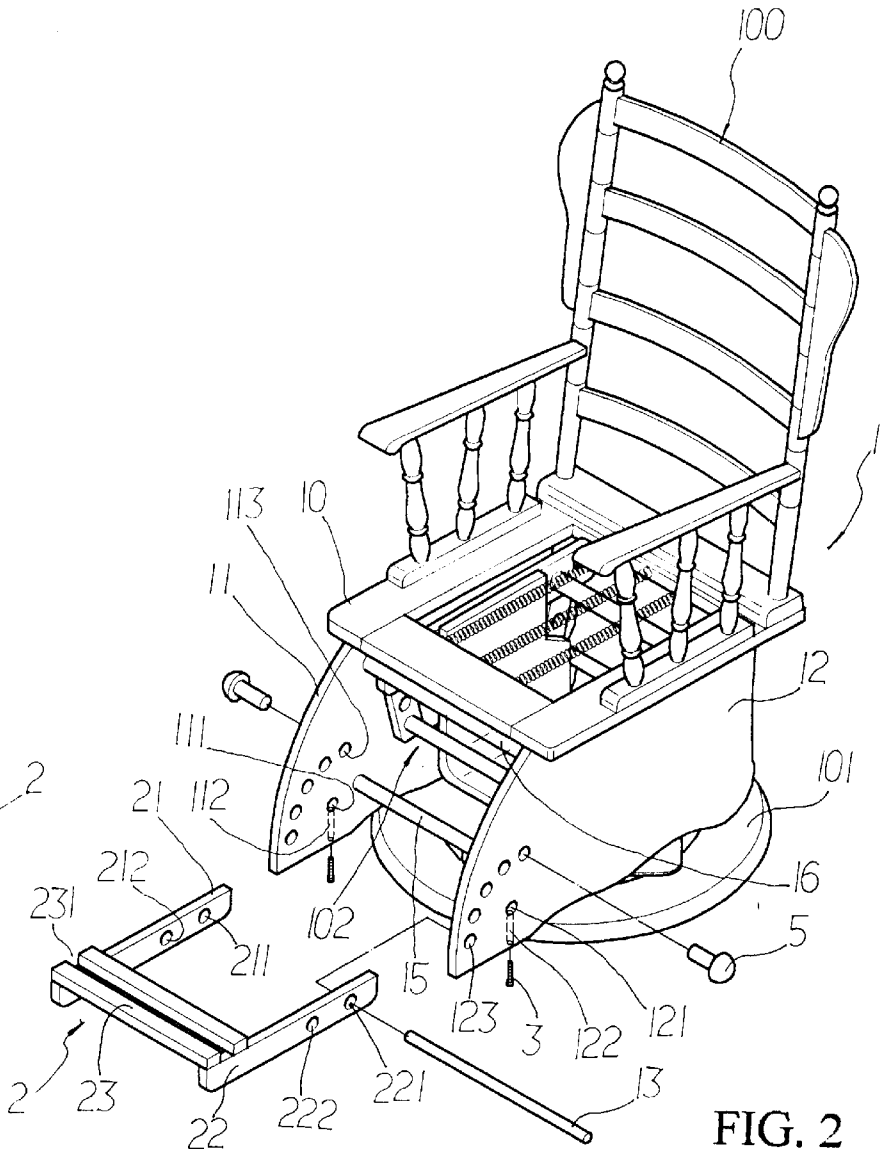
FIG. 2 is an exploded view of the rocking chair and a in accordance with the present invention.
Figure 3:
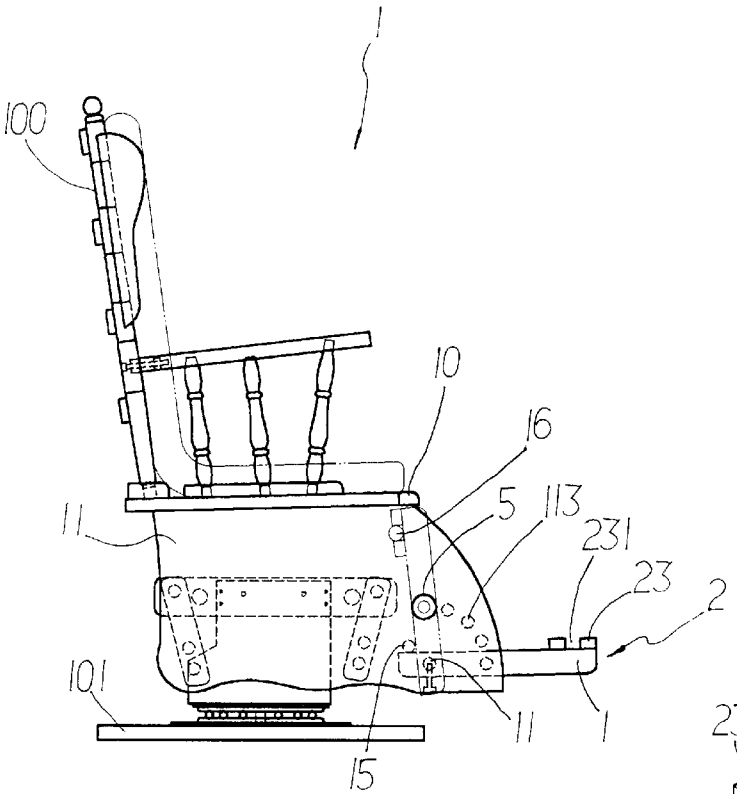
FIG. 3 is a side elevational view, partly in section, of the rocking chair and the footrest of the present invention connected to the chair.

Referring to FIGS. 2 and 3, the rocking chair 1 in accordance with the present invention comprises a seat 10, a seat back 100 extending from a rear edge of the seat 10, a stand 101 supporting the seat 10 and a rocking mechanism 102 connected to the stand 101. The seat 10 has two side panels 11, 12 respectively extending from two sides thereof and each of the two side panels 11, 12 has an engaging hole 111/121 defined there through. Two passages 112, 122 are respectively defined in the two side panels 11, 12 and communicate with the two engaging holes 111, 121. Each of the two side panels 11, 12 has a plurality of positioning holes 113, 123 defined therethrough. A first bar 15 and a second bar 16 are connected between the two panels 11, 12.

The footrest 2 has two side plates 21, 22 and each of the two side plates 21, 22 has an aperture 211/221 so that the two side plates 21, 22 are pivotally connected to the two side panels 11, 12 by extending a rod 13 through the two engaging holes 111, 121 of the two side panels 11, 12 and the two apertures 211, 221 of the two side plates 21, 22. Two bolts 3 respectively and threadedly extend into the two passages 112, 122 and contact against the rod 13 so that the rod 13 will not drop from the two side panels 11, 12. The two side plates 21, 22 of the footrest 2 are rested on the first bar 15 by their undersides when the footrest 2 is located at its lowest position. Each of the two side plates 21, 22 has a match hole 212/222 defined therethrough so that two pins 5 may extend through one of the positioning holes 113, 123 in the two side panels 11, 12 and the two match holes 212, 222 in the two side plates to position the footrest 2 relative to the two side panels 11, 12.

The footrest 2 has two notches 231 respectively defined in the two side plates 21, 22 and the two notches 231 are defined by two boards 23 connected between the two side plates 21, 22. A gap is defined between the two boards 23 and communicates with the two notches 231.

When adjusting the footrest 2, the two pins 5 are removed from the two side panels 11, 12 and pivoting the footrest 2 to a desired position to align the positioning holes 113, 123 with the match holes 212, 222, and inserting the two pins 5 into the aligned pairs of the positioning holes 113, 123 and the match holes 212, 222 to position the footrest 2. The footrest 2 may be folded between the two side panels 11, 12 by pivoting the footrest 2 about the rod 13 after the two bolts 3 are loosened, and engaging the second bar 16 with the gap and the two notches 231.

Figure 4:
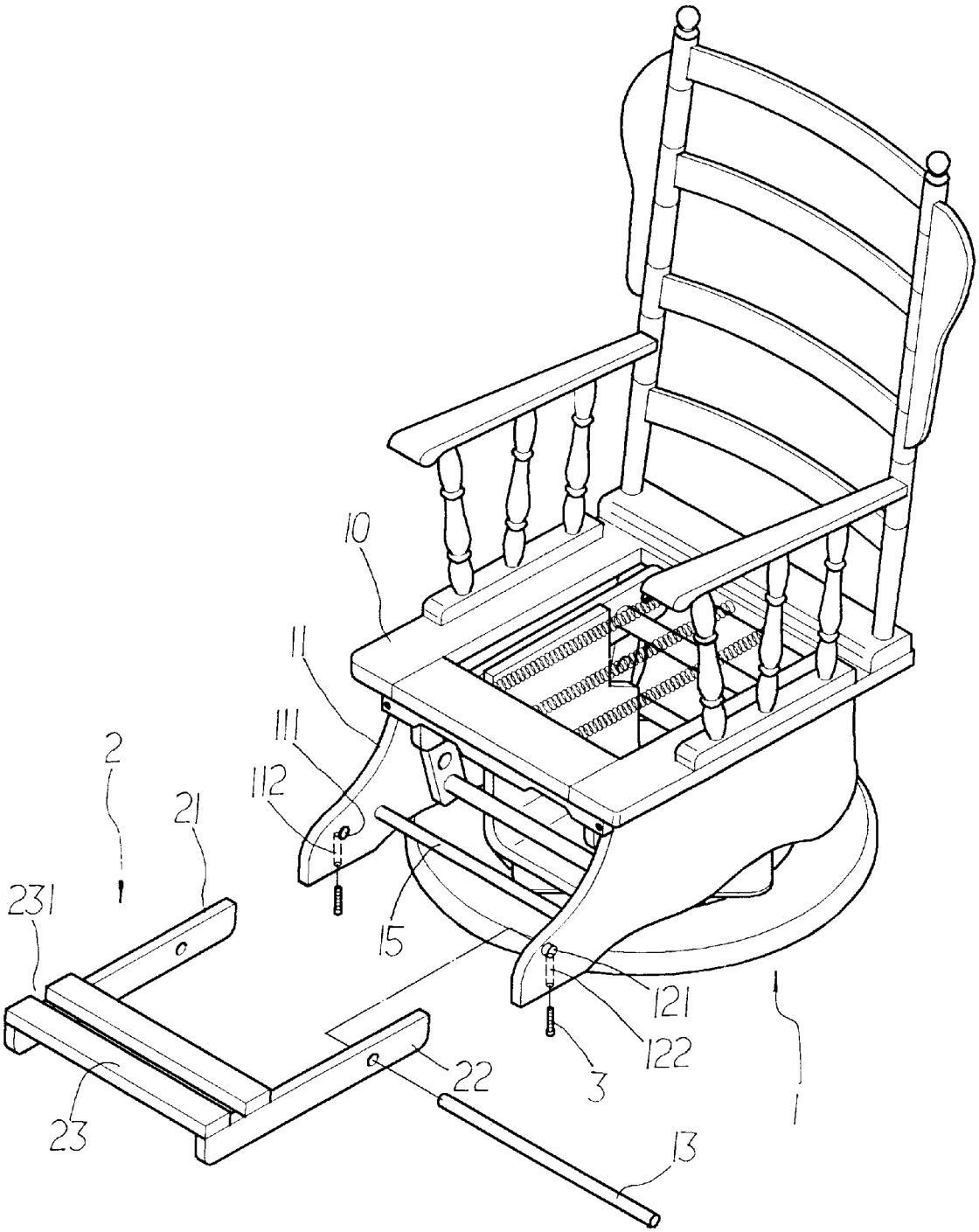
FIG. 4 is an exploded view of another embodiment of the rocking chair and the footrest in accordance with the present invention.
Figure 5:
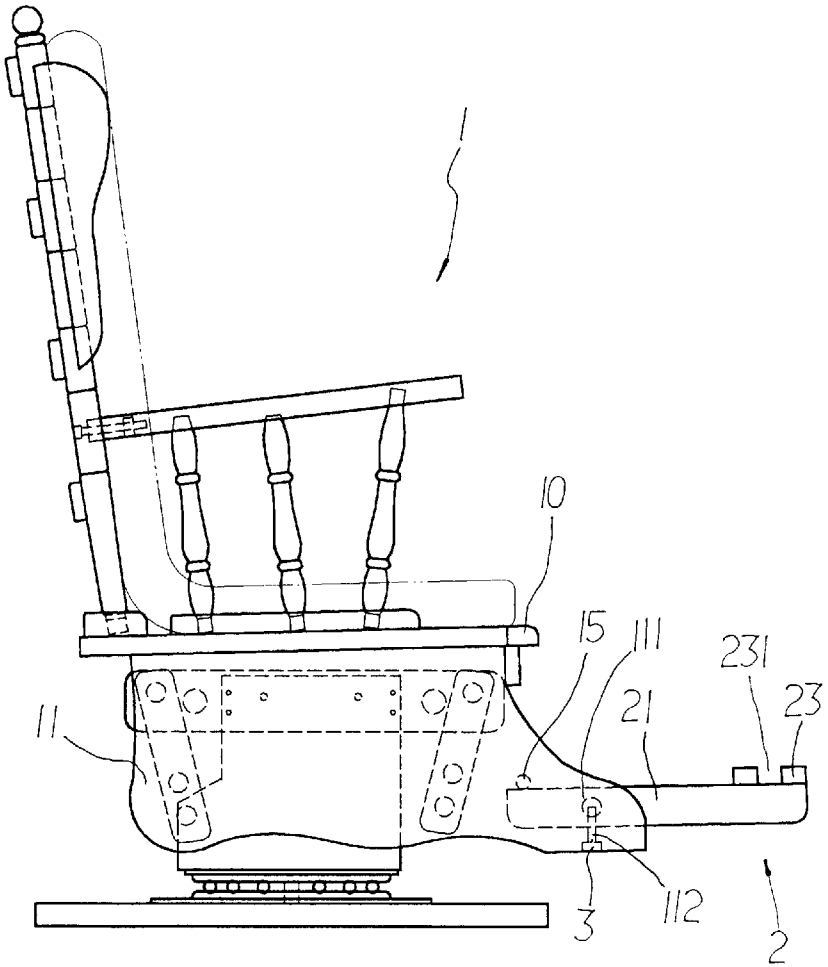
FIG. 5 is a side elevational view, partly in section, of the rocking chair and the footrest shown in FIG. 4.
Figure 6:
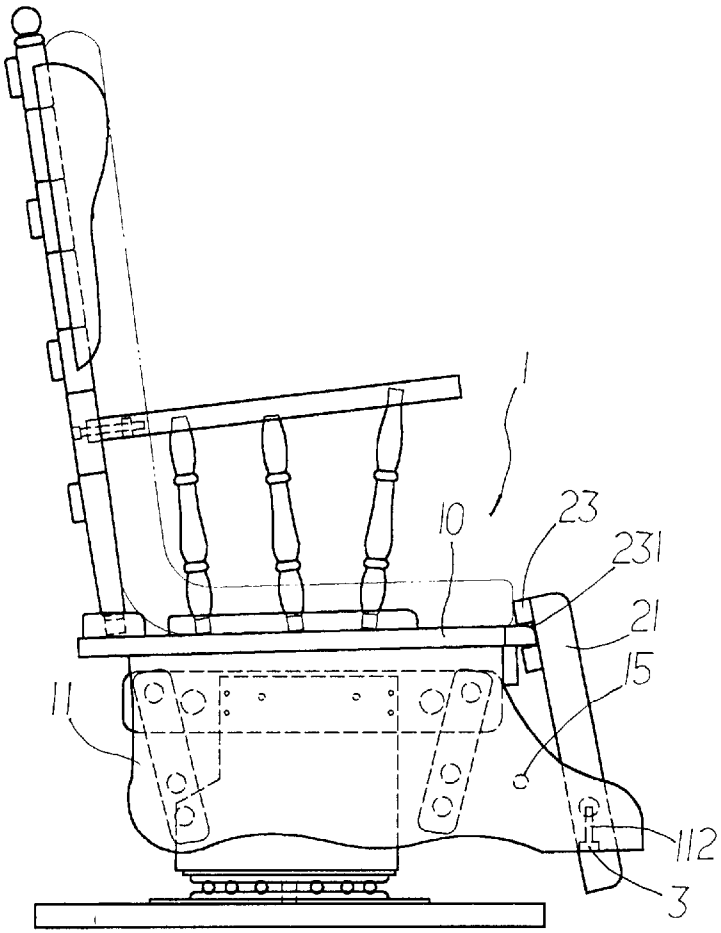
FIG. 6 is a side elevational view, partly in section, of the rocking chair and the footrest shown in FIG. 4, wherein the footrest is pivoted to be folded between the two side panels.

FIGS. 4 to 6 show another embodiment of the rocking chair 1 and the footrest 2, wherein the structure of the rocking chair 1 is the same as that shown in FIG. 2 except that the rocking chair 1 shown in FIGS. 4 to 6 lacks of the second bar 16 and the positioning holes 123, 113 as disclosed in FIGS. 2 and 3. The footrest 2 in FIGS. 4 to 6 is the same as that disclosed in FIGS. 2 and 3. Therefore, the two side plates 21, 22 are pivotably connected to the two side panels 11, 12 by rod 13 and the two bolts 3 extending through the passages 112, 122 are urged against the rod 13 in the two engaging holes 1 11, 121, and the two side plates 21, 22 are also able to be rested on the bar 15 connected between the two side panels 11, 12.

When folding the footrest 2, the front edge of the seat 10 is engaged with the two notches 231 and the gap between the two boards 23.

The invention is not limited to the above embodiment but various modification thereof may be made. It will be understood by those skilled in the art that various changes in form and detail may made without departing from the scope and spirit of the present invention.

What is claimed is:

1. A combination of a rocking chair and a footrest, said rocking chair comprising a seat with a front edge of said seat and two sides of said seat and a rear edge of said seat, a seat back extending upwardly from the rear edge of said seat, a stand supporting said seat and a rocking mechanism connected operatively to said stand, two side panels each extending downwardly respectively from one of the two sides of said seat, each of said two side panels having a first bar engaging hole and a second bar engaging hole defined therethrough, the second bar engaging holes positioned higher than the first bar engaging holes and underneath and near said front edge of said seat, a first bar received in both of said first bar engaging holes and connected between said two panels, a second bar received in both of said second bar engaging holes and connected between said two panels, each of said two side panels having a rod engaging hole, said footrest having two side plates and each of said two side plates having an aperture so that two side plates are pivotally connected to said two side panels by extending a rod through said two apertures of said two side plates and through said two rod engaging holes of said side panels, said footrest pivotable about said rod between a use position and a non-use position, in said use position said two side plates abutting upwardly against said first bar, in said non-use position said two side plates abutting against said second bar.

2. The combination as claimed in claim 1, wherein each of said two side panels has at least one positioning hole defined therethrough and each of said two side plates has a match hole defined therethrough, two pins extending through said at least one of said positioning holes in each of said two side panels and said two match holes in said two side plates for positioning said footrest relative to said two side panels.

3. The combination as claimed in claim 1, wherein said footrest has two notches each respectively defined in one of said two side plates so as to receive the front edge of said seat when said footrest is in said non-use position.

4. The combination as claimed in claim 1, further comprising two passages each respectively defined in one of said two side panels and communicating with said two engaging holes, two bolts respectively extending into said two passages and contactable against said rod for tightening.

5. The combination as claimed in claim 1, further comprising two boards connected between said two side plates with a gap between said two boards.

* * * * *